United States Patent [19]

Watt

[11] Patent Number: 4,644,875

[45] Date of Patent: Feb. 24, 1987

[54] ADJUSTABLE KEYBOARD SUPPORTING MECHANISM

[75] Inventor: Richard L. Watt, Jamestown, N.Y.

[73] Assignee: Weber-Knapp Company, Jamestown, N.Y.

[21] Appl. No.: 715,028

[22] Filed: Mar. 22, 1985

[51] Int. Cl.[4] ..... A47B 57/00

[52] U.S. Cl. ..... 108/93; 108/138; 108/143; 108/145

[58] Field of Search ..... 108/93, 96, 138, 143, 108/145, 4, 5; 312/27, 28, 29; 248/16

[56] References Cited

U.S. PATENT DOCUMENTS

| | | | |
|---|---|---|---|
| 1,315,922 | 9/1919 | Franklin | 108/143 |
| 1,900,250 | 3/1933 | Mitchell et al. . | |
| 2,170,098 | 8/1939 | Stephenson | 108/96 X |
| 2,194,889 | 3/1940 | DeLisle | 45/131 |
| 2,545,515 | 3/1951 | Gannett et al. | 108/138 |
| 2,822,229 | 2/1958 | Carlson | 312/27 |
| 3,425,761 | 2/1969 | Schreyer | 312/28 |
| 3,516,369 | 6/1970 | Bidak et al. | 108/138 |
| 3,866,866 | 2/1975 | Knelle | 108/138 X |
| 4,379,429 | 4/1983 | Gubbe et al. | 108/143 X |
| 4,384,532 | 5/1983 | Staff | 108/72 |

FOREIGN PATENT DOCUMENTS

| | | | |
|---|---|---|---|
| 2320344 | 11/1974 | Fed. Rep. of Germany | 108/96 |

OTHER PUBLICATIONS

Literature reference pertaining to "Roll-Out PC Support System"; p. 4, Global Computer Supplies.
Copy of letter dated Mar. 7, 1985 from Weber-Knapp Company, Engineering drawing identified as X-21,267.
Plate identified as X-21,267-D.
Plate identified as X-21,473.

*Primary Examiner*—Peter A. Aschenbrenner
*Assistant Examiner*—Jose V. Chen
*Attorney, Agent, or Firm*—Bean, Kauffman & Bean

[57] ABSTRACT

A mechanism is disclosed for use in supporting a keyboard in a desired adjustable position relative to a CRT unit at a work station. The mechanism is adapted for attachment to the downwardly facing surface of a suitable horizontal support arranged at various levels or distances from a floor; and is characterized as being capable of mounting a keyboard for horizontally directed movements between storage or retracted and use or extended positions and for vertically directed movements into maximum upper and lower use positions in opposite directions from an intermediate or reference position normally assumed by the keyboard when in its storage position, wherein means are provided to automatically move the keyboard from its upper position into its intermediate position incident to movement of the keyboard horizontally towards its storage position.

5 Claims, 7 Drawing Figures

ADJUSTABLE KEYBOARD SUPPORTING MECHANISM

BACKGROUND OF THE INVENTION

The present invention relates to mechanisms for supporting a keyboard in a desired vertically adjusted position relative to a CRT unit and for movements between storage or retracted and use or extended positions.

Mechanisms of various types, including those described in commonly assigned, pending U.S. patent application Ser. No. 610,341, filed May 15, 1984, have been proposed for use in supporting keyboards or other business machines for horizontal movements between storage and use positions and/or to permit the use position thereof to be vertically adjusted for purposes of minimizing operator fatigue. Certain of these prior mechanisms are adapted for connection to the downwardly facing or lower surface of a desk or table top in order to facilitate the creation of CRT work stations at any desired office location. Certain other of these prior mechanisms are adapted for use in association with keyboard storage boxes, which are intended to be supported on a table or desk top and in turn serve to support a CRT unit. However, prior mechanisms of which I am aware lack versatility from the standpoint that they are not adapted for universal mounting selectively to a table or desk top or within a storage box.

SUMMARY OF THE INVENTION

The present invention is directed to a keyboard supporting mechanism adapted for attachment selectively to a table or desk top or within a storage box intended for supporting a CRT unit on a convenient work surface.

The present keyboard supporting mechanism generally includes a pair of slide devices having first parts adapted for attachment to depend from a downwardly facing or lower surface of a suitable support and second parts supported by the first parts for horizontally directed reciprocating movements; keyboard supporting means; two pairs of links cooperating to support the keyboard supporting means for vertically directed movement relative to the second parts; and means for releasably clamping the keyboard supporting means in a desired vertically adjusted position. Spring means preferably interconnect the second parts to the links for purposes of at least partially counterbalancing the weight of the keyboard supporting means and the keyboard supported thereon.

In accordance with the present invention, the keyboard supporting means is capable of assuming a reference position closely adjacent to the support, so as to provide a thin vertical profile for the mechanism and keyboard while in storage or retracted position. Further, the elements of the mechanism are preferably constructed and arranged to provide for oppositely directed vertical displacements of the keyboard supporting means from its reference position into maximum upper and lower use positions. This construction allows the present mechanism to be selectively housed within a keyboard storage box or beneath a table or desk top, while accommodating for a full range of vertical movements of the keyboard into positions convenient for use by an operator.

It is an important feature of the present invention that means, such as may be defined by one of the links of each pair and the first parts of the slide devices, are provided to automatically move the keyboard supporting means from its upper use position downwardly into its reference position, as an incident to horizontal movement of the keyboard into its storage position.

DRAWINGS

The nature and mode of operation of the present invention will now be more fully described in the following detailed description taken with the accompanying drawings wherein.

DETAILED DESCRIPTION

A keyboard supporting mechanism of the present invention is generally designated as 10 and shown by way of example as being arranged within a keyboard storage box 12 of the type having an upper wall or panel 14 adapted to support a CRT unit, not shown, above a desk or table top 16 to define a work station.

Figures 1, 2:
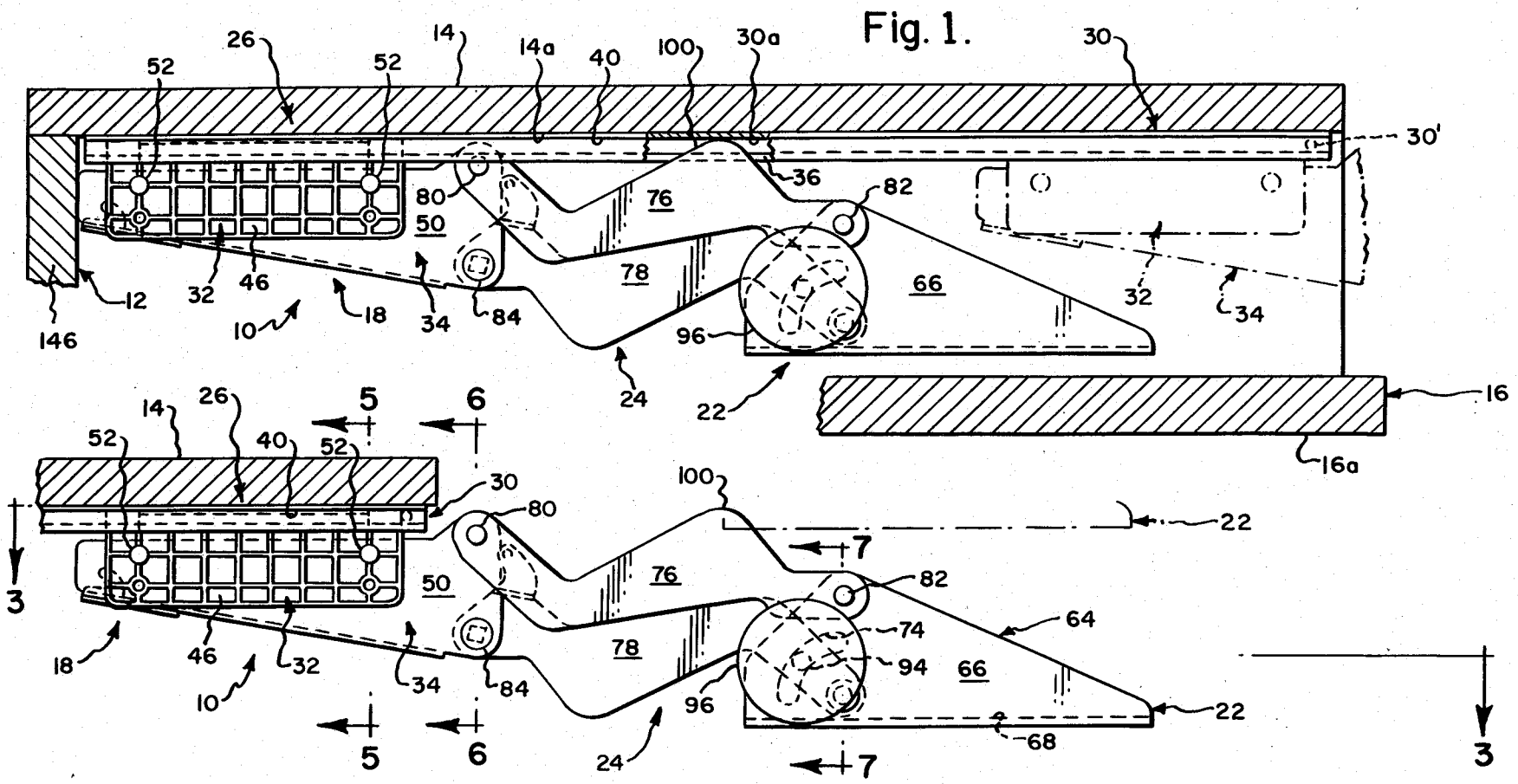
FIG. 1 is a side elevational view of the mechanism of the present invention showing the mechanism in a keyboard storage or retracted position.
FIG. 2 is a view similar to FIG. 1, but showing the mechanism in a keyboard use or extended position.
Figure 3:
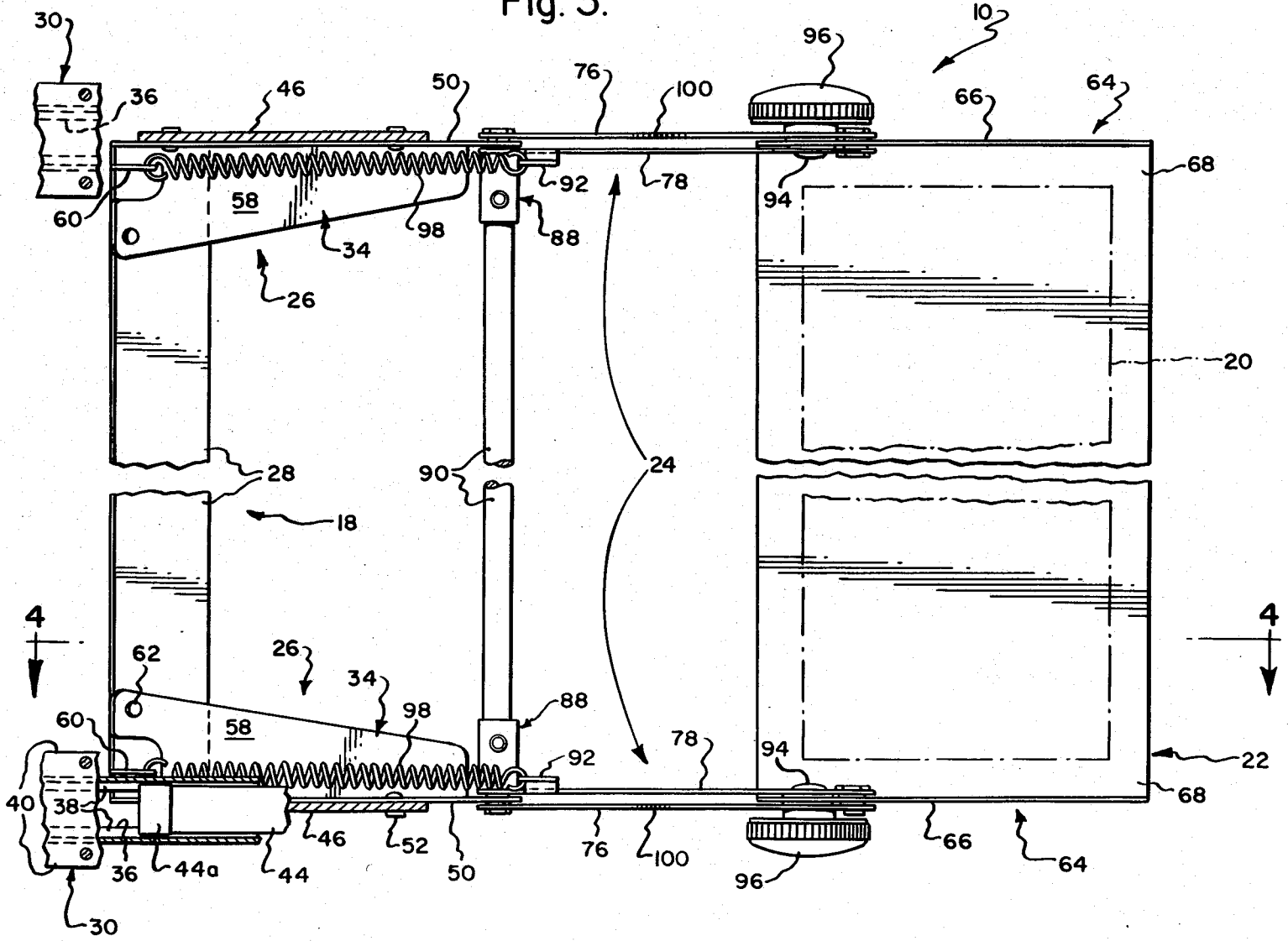
FIG. 3 is a sectional view taken generally along the line 3—3 in FIG. 2.

Mechanism 10 generally comprises mounting/extension means 18 for attaching the mechanism to a bottom surface 14*a* of wall 14 and for permitting horizontally directed reciprocating movements of a keyboard, which is generally designated at 20 only in FIG. 3, between retracted or storage and extended or use positions depicted in full line in FIGS. 1 and 2, respectively; support means 22 for supporting the keyboard; and link means 24 for supporting the support means on mounting/extension means for vertically directed movements between upper and lower keyboard use positions, which are shown in broken line in FIG. 2, relative to a vertically intermediate or reference position, which is shown in full line in FIGS. 1 and 2.

Mounting/extension means 18 includes a pair of slide devices 26 and 26, which are preferably operably interconnected by a stiffener plate 28. In that slide devices 26 and 26 are of mirror image construction, only the left hand slide device best shown in FIGS. 1–6 will be specifically described with like numerals being employed to designate like parts of the right hand slide device shown only in FIG. 3. More specifically, left hand slide device 26 includes a first part preferably defined by a horizontally elongated guide track in the form of an extruded metal channel 30 and a second part preferably defined by a follower member 32 and a mounting bracket 34.

Figure 5:
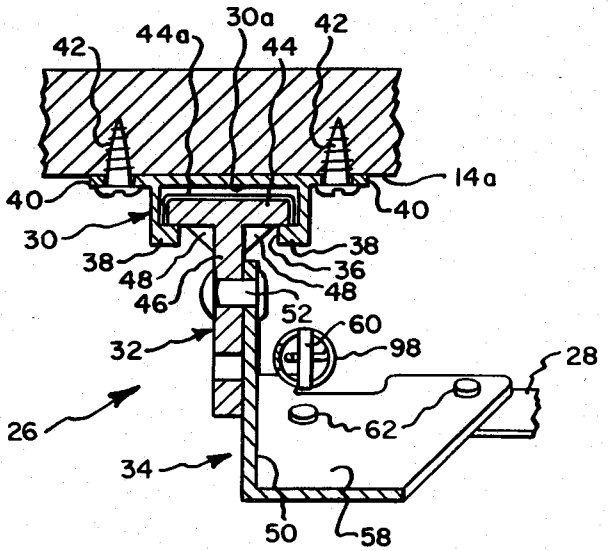
FIG. 5 is a sectional view taken generally along the line 5—5 in FIG. 2.

Channel 30 is best shown in FIG. 5 as being formed to provide a downwardly opening guide slot 36, which is bounded by a pair of channel leg flanges terminating in aligned guide flanges 38 and 38, and an integrally formed, upper mounting flange serving to define a pair of mounting flanges 40 and 40, which are apertured to receive suitable attachment devices, such as screws 42.

Follower member 32 is also best shown in FIG. 5 as having a generally T-shaped cross-sectional configuration defined by a head portion 44, which is slidably supported within channel 30 by guide flanges 38 and 38, and a depending flange portion 46, which is sized and arranged to depend or extend downwardly through guide slot 36. Follower member 32 may be strengthened by providing same with a plurality of triangular webs 48, which are arranged adjacent the juncture of portions 44 and 46 and uniformly spaced apart lengthwise thereof, and the opposite ends of head portion 44 may be slightly enlarged, as at 44*a*, for purposes of limiting the area of the head portion arranged in actual sliding engagement with guide flanges 38 and 38. Friction between channel 30 and follower member 32 may be further reduced by forming the latter of a suitable plastic material. Mounting bracket 34 is best shown in FIGS. 1–5 as having an L-shaped cross-sectional configuration defined by an upstanding plate portion 50, which is rigidly fixed to depending flange portion 46 by a plurality of suitable fasteners 52 and has its forwardly disposed end provided with upper and lower mounting apertures 54 and 56 best shown in FIG. 6; and by a horizontally extending plate portion 58, which projects inwardly of mechanism 10 and is formed with a mounting hook 60 and apertures, not shown, for receiving suitable stiffener plate mounting fasteners 62.

The fully extended and retracted position of mechanism 10 depicted in FIG. 1 may be variously defined, such as by providing the front end of channel 30 with a front stop pin 30' arranged for engagement by follower 32 and by engagement of the rear end of mounting bracket 34 with the inner surface of box rear wall 14*b* or alternatively by providing channel 30 with a rear stop pin, not shown.

Figure 4:
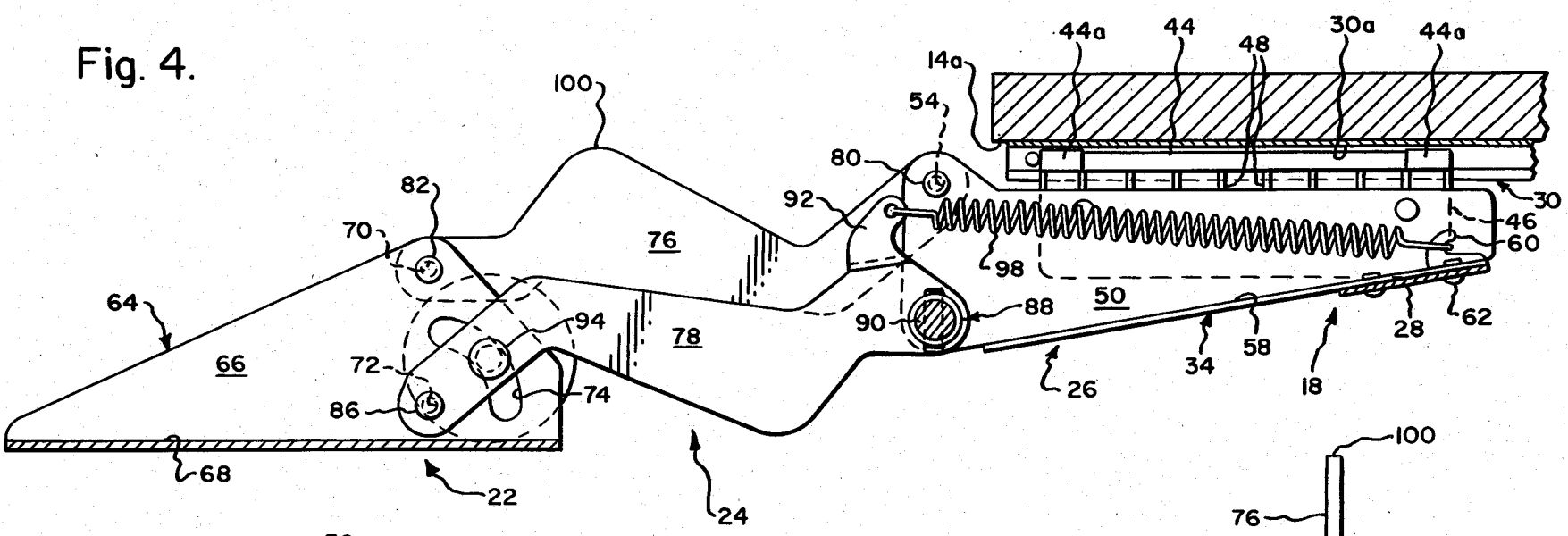
FIG. 4 is a sectional view taken generally along the line 4—4 in FIG. 3.
Figure 7:
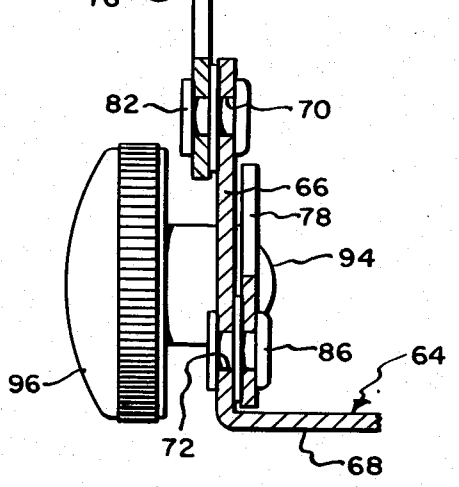
FIG. 7 is a sectional view taken generally along the line 7—7 in FIG. 2.

Support means 22 may be variously defined, but is shown in the drawings as comprising left and right hand support brackets 64 and 64 of mirror image construction. The left hand bracket 64 is best shown in FIGS. 3, 4 and 7 as having an L-shaped cross-sectional configuration defined by an upstanding plate portion 66 and a horizontally extending plate portion 68. In the illustrated construction, support brackets 64 and 64 are rigidly interconnected by integrally forming plate portions 68. Alternatively, the support brackets may be separately formed and rigidly fixed to opposite ends of a suitable keyboard supporting panel or tray, not shown. Plate portion 66 is best shown in FIGS. 4 and 7 as being formed with upper and lower mounting apertures 70 and 72 and an arcuate slot 74, which is disposed concentrically of the axis of lower aperture 72.

Figure 6:
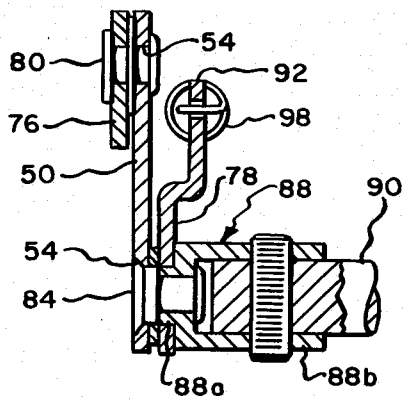
FIG. 6 is a sectional view taken generally along the line 6—6 in FIG. 2.

Link means 24 are best shown in FIGS. 1–4 as including left and right hand pairs of upper and lower links 76 and 78, whose rear or first and front or second ends are pivotally connected to mounting and support brackets 34 and 64, respectively. More specifically, the upper left hand link 76 is best shown in FIG. 4 as having its rear and front ends pivotally supported by bearing or pivot pin devices 80 and 82 received within upper apertures 54 and 70, respectively. The lower left hand link 78 is best shown in FIGS. 6 and 7 as having its rear and front ends pivotally supported by bearing or pivot pin devices 84 and 86, respectively. Thus, links 76 and 78 cooperate with mounting and support brackets 34 and 64 to define a pair of parallel, parallelogram type linkages.

By reference to FIG. 6, it will be understood that the rear end of lower link 78 is actually supported on a collar or sleeve-like member 88 having a first end 88*a* fixed to pin device 84 and an opposite end 88*b* keyed or non-rotatably fixed to a torsion rod or member 90, which serves to tie together the lower links for conjunctive pivotal movement. Lower link 78 is suitably keyed against rotation relative to collar first end 88*a*, and thus torsion rod 90, such as by providing the collar first end and a mating mounting opening in the lower link with a non-round configuration.

By again referring to FIGS. 3, 4 and 6, it will be understood that lower link 78 has its rearwardly disposed end shaped to provide a hook or apertured member 92 and has its front end formed with a non-round aperture, not shown, serving to non-rotatably mount a stud or member 94, which is slidably received within arcuate slot 74 and has its free end threaded to adjustably mount an adjustment or clamping knob 96. As will be apparent, engagement of stud 94 with the opposite ends of slot 74 serves to define the maximum upper and lower use positions of support means 22 and a keyboard supported thereby, which are shown in broken line in FIG. 2; and adjustment of knob 96 serves to releasably clamp bracket flange portion 66 intermediate the knob and lower link 78 for purposes of releasably locking the support means and keyboard in any desired use position within their range of movement between such maximum upper and lower use positions.

Preferably, hook members 60 and 92 are provided on each side of mechanism 10 for purposes of mounting the rear and front ends of a pair of tension spring devices 98, which serve to at least partially counterbalance the weight of support means 22 and keyboard 20. Depending on installation requirements, the strength of springs 98 may be chosen to normally bias the support means and keyboard into their maximum upper use position, to permit same to normally settle into their maximum lower use position or to be essentially counterbalanced same throughout their range of movement. Also, by referring to FIGS. 1–4, it will also be understood that the upper edge of upper link 76 is preferably shaped to define a cam surface 100, which is sized and arranged to removably project upwardly into channel 30 through slot 36 for engagement with channel inner surface 30*a*.

By again making reference to FIG. 1, it will be noted that the elements comprising mechanism 10 are constructed and arranged to provide the mechanism with a thin vertical profile when the keyboard is in its stored or fully retracted position depicted in full line in FIG. 1. In this stored position, the keyboard and its support are considered as occupying an intermediate or reference position, whose limits are defined for the illustrated installation by engagement of cam surface 100 with channel inner surface 30*a* and by engagement of support means 22 or the lower marginal edge of lower links 78 with a bottom panel or wall of box 14, not shown, or an upper surface of table top 16. Alternatively, knob 96 may be employed to lock the keyboard in any position intermediate these limits. When it is desired to place the keyboard in use, its support means is simply pulled forwardly until sliding movement of follower 32 within channel 30 is arrested by suitable means, such as stop pin 30'. Support means 22 is then manually moved up or down from its intermediate position, as assisted by or against the bias of springs 98, until the keyboard is arranged at a comfortable level for a user and then knob(s) 96 tightened in order to lock the keyboard in its desired use position. When a user desires to return the keyboard to its storage position, the above operation is simply reversed.

It is desirable to prevent damage to the keyboard, during movement thereof towards storage position, as well as during removal therefrom, which might occur if the keyboard were permitted to engage with lower or mounting surface 14*a*. In accordance with the present invention, possible engagement of the keyboard with the mounting surface is prevented by providing the upper link(s) 76 with cam surfaces 100, which are position for sliding and camming engagement with channel inner surface 30*a*, when required to automatically lower the keyboard into its intermediate position incident to movement thereof horizontally towards its stored position.

While mechanism 10 has been specifically shown as being mounted within a keyboard storage box intended to be arranged on a table or desk top 16, it will be understood that the mechanism is equally adapted for attachment to the lower surface by any suitable horizontal support, such as the lower surface 16*a* of such table or desk top. The capability of mounting mechanism 10 at various levels or distances from a floor is a highly desirable feature of the invention and achieved by providing for a relatively wide range of vertical movements of a keyboard both above and below an intermediate or reference position it assumes when in its stored position.

What is claimed is:

1. A mechanism for mounting a keyboard for movement relative to a horizontal support, said mechanism comprising:

a pair of slide devices defined by first parts having means for fixing same to depend from a lower surface of said support and second parts supported by said first parts for horizontally directed reciprocating movements between keyboard storage and use position, said first parts are horizontally elongated guide channels having downwardly opening guide slots bounded by pairs of aligned guide flanges, said second parts are defined by followers slidably supported one by each of said guide tracks and mounting brackets carried one on each of said followers, said followers have a generally T-shaped sectional configuration with head portions thereof slidably supported within said guide channels by said guide flanges and with depending portions thereof depending downwardly through said guide slots, said mounting brackets are of L-shaped cross-sectional configurations having upstanding plate portions fixed to said depending portions and defining an upper aperture and a lower aperture and horizontally extending plate portions arranged in a facing relationship and shaped to define mounting hooks;

support means for supporting said keyboard, said support means includes a pair of support brackets each having an upper aperture and a lower aperture, at least one of said support brackets having an arcuate slot disposed concentrically of said lower aperture thereof, said support brackets are associated one with each of said mounting brackets, said support brackets are of L-shaped cross-sectional configuration having upstanding plate portions defining said upper and lower apertures of said support brackets and horizontally extending plate portions arranged in a facing relationship;

link means for supporting said support means on said second parts for vertically directed movements between upper and lower keyboard use positions relative to an intermediate position in which said support means and said keyboard may be stored closely adjacent said lower surface to provide a thin vertical profile for said mechanism and said keyboard when said second parts are disposed in said keyboard storage position, said link means includes two pairs of upper and lower links with first and second ends of the upper and lower links of each pair pivotally supported relative to said upper and lower apertures of associated ones of said mounting and support brackets, respectively, at least one of said lower links carrying a member slidably received within said arcuate slot for engagement with opposite ends thereof to define said upper and lower keyboard use positions, said member having a free end thereof threaded to adjustably support a clamping device cooperating with said one of said lower links to releasably clamp said one of said support brackets therebetween and thereby releasably lock said support means in any use position throughout the range of its movement between said upper and lower keyboard use positions, said upper links lie adjacent oppositely facing surfaces of said upstanding plate portions of said mounting and support brackets in vertical alignment with said guide slots, said lower links lie adjacent facing surfaces of said upstanding plate portions of said mounting and support brackets and are shaped to define mounting hooks; and spring means coupling said mounting brackets to said lower links to at least partially counterbalance the weight of said support means and keyboard supported thereon, said spring means comprise a pair of spring devices having opposite ends thereof fixed to said mounting hooks of said mounting brackets and said lower links, said first ends of said lower links are coupled transversely of said mechanism by a torsion member, and said upper links have cam surfaces shaped and arranged to engage interiorly of said guide channels for moving said support means into said intermediate position from said upper use position incident to movement of said second parts towards said keyboard storage position.

2. The mechanism of claim 1, wherein said support brackets are rigidly interconnected by integrally forming said horizontally extending plate portions thereof.

3. A mechanism for mounting a keyboard for movement relative to a horizontal support, said mechanism comprising:

a pair of slide devices defined by first parts having means for fixing same to depend from a lower surface of said support and second parts supported by said first parts for horizontally directed reciprocating movements between keyboard storage and use positions;

support means for supporting said keyboard; and link means for supporting said support means on said second parts for vertically directed movements between upper and lower keyboard use positions relative to an intermediate position in which said support means and said keyboard may be stored closely adjacent said lower surface to provide a thin vertical profile for said mechanism and said keyboard when said second parts are disposed in said keyboard storage position, said first parts are horizontally elongated guide channels having downwardly opening guide slots bounded by pairs of aligned guide flanges, said second parts include followers having a generally T-shaped sectional configuration with head portions thereof slidably supported within said guide channels by said guide flanges and with depending portions thereof depending downwardly through said guide slots and means for mounting said link means on said depending portions, said link means includes two pairs of upper and lower links cooperating with said support means and said second parts to define parallelogram linkages, and said upper links have cam surfaces shaped and arranged to removably extend through said guide slots for engagement with said guide channels interiorly thereof for moving said support means into said intermediate position from said upper use position incident to movement of said second parts towards said keyboard storage position.

4. A mechanism for mounting a keyboard for movement relative to a horizontal support, said mechanism comprising:

a pair of slide devices defined by first parts having means for fixing same to depend from a lower surface of said support and second parts supported by said first parts for horizontally directed reciprocating movements between keyboard storage and use positions;

support means for supporting said keyboard;

link means for supporting said support means on said second parts for vertically directed movements between upper and lower keyboard use positions relative to an intermediate position in which said support means and said keyboard may be stored closely adjacent said lower surface to provide a thin vertical profile for said mechanism and said keyboard when said second parts are disposed in said keyboard storage position; and cam means provided on the link means, whereby engagement with the first part forces said support means to move into said intermediate position from said upper use position upon movement of said second parts towards said keyboard storage position.

5. A mechanism according to claim 2, wherein means are provided to releasably lock said support means in any desired use position throughout the range of its movement between said upper and lower keyboard use positions.

* * * * *